US007249540B1

(12) United States Patent
Hacker et al.

(10) Patent No.: US 7,249,540 B1
(45) Date of Patent: Jul. 31, 2007

(54) CONNECTOR ADAPTER

(75) Inventors: Scott C. Hacker, League City, TX (US); Richard J. Dean, Friendswood, TX (US); Scott W. Burge, Friendswood, TX (US); Toby W. Dartez, Alvin, TX (US)

(73) Assignee: United States of America as represented by the Administrator of the National Aeronautics and Space Administration, Washington, DC (US)

( * ) Notice: Subject to any disclaimer, the term of this patent is extended or adjusted under 35 U.S.C. 154(b) by 57 days.

(21) Appl. No.: 11/177,652

(22) Filed: Jul. 1, 2005

(51) Int. Cl.

| | |
|---|---|
| ***B25B 13/00*** | (2006.01) |
| ***B25B 13/02*** | (2006.01) |
| ***B25B 13/52*** | (2006.01) |
| ***B25B 5/22*** | (2006.01) |
| ***B25B 5/34*** | (2006.01) |
| ***B25B 31/12*** | (2006.01) |
| ***B25G 3/02*** | (2006.01) |

(52) U.S. Cl. ..... 81/124.5; 81/65; 81/125; 279/42; 279/52

(58) Field of Classification Search ..... 81/124.2, 81/65, 438, 439, 125, 451; 279/42, 52; 483/20
See application file for complete search history.

(56) References Cited

U.S. PATENT DOCUMENTS

| | | | | |
|---|---|---|---|---|
| 1,179,288 | A * | 4/1916 | Curry | 279/42 |
| 1,587,647 | A * | 6/1926 | Hood et al. | 81/438 |
| 1,758,261 | A * | 5/1930 | Addison | 279/36 |
| 2,214,241 | A * | 9/1940 | Baxendale | 279/46.3 |
| 2,370,407 | A * | 2/1945 | McCartney | 81/453 |
| 2,374,192 | A * | 4/1945 | Godfrey | 279/51 |
| 2,561,407 | A * | 7/1951 | Palmer | 81/113 |
| 2,701,489 | A * | 2/1955 | Osborn | 81/53.2 |
| 2,842,020 | A * | 7/1958 | Tarquinio | 81/177.2 |
| 3,806,225 | A | 4/1974 | Codrino | |
| 4,575,274 | A | 3/1986 | Hayward | |
| 4,724,731 | A | 2/1988 | Onofrio | |
| 4,784,612 | A * | 11/1988 | Ryan | 439/367 |
| 4,858,312 | A | 8/1989 | Van Naarden | |
| 4,945,791 | A | 8/1990 | Herschler et al. | |
| 5,137,288 | A * | 8/1992 | Starkey et al. | 279/42 |
| 5,415,065 | A * | 5/1995 | McMills | 81/467 |
| 5,664,467 | A * | 9/1997 | Breeze | 81/114 |
| 6,276,237 | B1 | 8/2001 | Stacy | |
| 6,626,610 | B1 * | 9/2003 | Seegmiller | 405/259.5 |
| 6,715,384 | B1 * | 4/2004 | Kozak | 81/124.2 |
| 6,938,522 | B1 * | 9/2005 | Stannik | 81/124.2 |
| 2002/0135912 | A1 * | 9/2002 | Ryall et al. | 359/892 |

* cited by examiner

*Primary Examiner*—Joseph J. Hail, III
*Assistant Examiner*—Bryan Muller
(74) *Attorney, Agent, or Firm*—Theodore U. Ro

(57) ABSTRACT

An adapter for installing a connector to a terminal post, wherein the connector is attached to a cable, is presented. In an embodiment, the adapter is comprised of an elongated collet member having a longitudinal axis comprised of a first collet member end, a second collet member end, an outer collet member surface, and an inner collet member surface. The inner collet member surface at the first collet member end is used to engage the connector. The outer collet member surface at the first collet member end is tapered for a predetermined first length at a predetermined taper angle. The collet includes a longitudinal slot that extends along the longitudinal axis initiating at the first collet member end for a predetermined second length. The first collet member end is formed of a predetermined number of sections segregated by a predetermined number of channels and the longitudinal slot.

8 Claims, 4 Drawing Sheets

CONNECTOR ADAPTER

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 U.S.C. 2457).

BACKGROUND OF THE INVENTION

1. Field of the Invention

The present invention relates generally to a connector adapter for installing a connector that is attached to the end of a cable onto a terminal post and more particularly to a means for assuring a proper torque setting of an electrical cable connector, wherein the cable is a coaxial cable or the like, installed in functional systems.

2. Description of the Prior Art

In the past, connectors and more particularly, electrical connectors have been installed by turning the connector "by-hand" without the use of tools. This by-hand procedure is convenient and fast, however the "finger tight" connector-to-terminal post engagement does not provide the necessary torque required for a variety of applications. For example, in space flight applications, a required torque level is necessary for accelerometer cable connectors to avoid the occurrence of loosening due to various vibrations that transpire during certain flight phases such as ascent, on-orbit operations, and descent. As another example, in terrestrial-based applications, a required torque level is necessary in certain electrical connectors to avoid moisture penetration to protect high impedance contacts. As still another example, in certain electrical connectors, a required torque level is necessary to compress elastic fillers in a terminal post and secure a pin or a plurality of sockets connected to wires extending from the connector to their functional terminals. Accurate torque application is necessary to preclude under or over compression of the connector filler with consequences of loss of electrical contact at its pins or sockets, or distortion of the same through over tightening. Thus, a manufacturer for a particular connector may require a specific torque range for proper operation of their connectors.

Open-end wrenches have been and are employed directly to the connector to obtain a tighter connection. However, post access with this bulky tool is difficult, and the connection is sometimes over-tightened resulting in damage to the connector, post, or both. Further, off-center wrench applicators often provide erroneous readings and result in slippage of contact surfaces. To address these problems, a variety of adapter devices have been developed in connection with a proper applicator tool. These devices all vary in design and purpose. Most devices are limited to operating on hexagonal-head connectors, because hexagonal-head connectors are generally the industry standard. Therefore, these devices do not address the issue of operating on non-hexagonal head connectors, such as, for example, round connectors. Further, as will be discussed in more detail infra, most devices have a means for establishing a pre-application hoop compression load to hold the connector in place before installing the connector. There are two primary designs in the prior art for establishing this pre-application hoop compression load.

The first primary type of design is described in U.S. Pat. No. 4,945,791, issued on Aug. 7, 1990, to Herschler et al., who discloses an adapter used for applying a specified torque to the back shells of electrical connectors. Herschler et al. uses a clamping means with a separable closure and adjustable friction-producing strap bonded to the outer lower lip of the adapter for establishing a pre-application hoop compression load. A user inserts the connector in Herschler's adapter and then proceeds to tighten the clamping means with a separate tool so that the friction-producing strap firmly compresses the connector against the inner surface of the adapter. For obvious reasons, use of Herschler's invention, although functional, is time-consuming and awkward.

The second primary type of design is described in U.S. Pat. No. 5,415,065, issued on May 16, 1995, to McMills, who discloses a hand tool employed to tighten a connector nut at the end of an electrical cable on a cable terminal post. McMills uses sleeve, which is separable from the body member of his hand tool. A user inserts the connector in McMills' hand tool and then slides the separate sleeve over the end of the hand tool wherein the connector now resides. McMills' hand tool is tapered such that when the user slides the sleeve the compression load is increased as the sleeve is slid further along the hand tool. McMills' design is also functional, but the use of a separate sleeve member can result in the user losing or misplacing the separate sleeve member. Further the user may inadequately slide the sleeve, which can result in the sleeve falling off before the user installs the connector. In addition, the hand tool's working load tension has a critical value above which the tensile expansion of the sleeve permits the side walls of the hand tool to slip around the connector when a predetermined torque value is exceeded. Thus, the sleeve is directly dependent to meeting the proper torque value.

It would be desirable to design a more elegant approach for installing a connector attached to a cable to address the variety of problems that still exist in the prior art.

SUMMARY OF THE INVENTION

Accordingly, it is an object of the present invention to provide a new and improved adapter used for the installation of a connector attached to a cable.

Another object of the present invention is to provide a self-contained adapter with no parts external to the adapter itself.

Another object of the present invention is to provide an adapter, which can be used to accept an applicator tool, such as, for example, a torque wrench.

These and other objects of the present invention are accomplished by providing an adapter for tightening a connector at the end of a cable to install the connector and hence, the cable to a terminal post.

In an embodiment, the adapter is an elongated collet member having a longitudinal axis comprised of a first collet member end, a second collet member end, an outer collet member surface, and an inner collet member surface. The inner collet member surface at the first collet member end is used to engage the connector. The outer collet member surface at the first collet member end is tapered for a predetermined first length at a predetermined taper angle. The collet includes a longitudinal slot that extends along the longitudinal axis initiating at the first collet member end for a predetermined second length. The first collet member end is formed of a predetermined number of sections segregated by a predetermined number of channels and the longitudinal slot.

In another embodiment, the adapter is comprised of an elongated body member, an elongated collet member, and a locking nut. The elongated body member has a first longitudinal axis comprised of a first body member end, a second body member end, an outer body member surface, and an inner body member surface. The inner body member surface at the first body member end is tapered for a predetermined first length at a predetermined first taper angle. And a first longitudinal slot extends along the first longitudinal axis for a predetermined second length. The elongated collet member has a second longitudinal axis and is comprised of a first collet member end, a second collet member end, an outer collet member surface, and an inner collet member surface. The outer collet member surface is positioned inside the inner body member surface in longitudinal spaced relation. The inner collet member surface at the first collet member end is used to engage the connector. The outer collet member surface at the first collet member end is tapered for a predetermined third length at a predetermined second taper angle. A second longitudinal slot extends along the second longitudinal axis for a predetermined fourth length. Further, the second longitudinal slot along the collet member is aligned with the first longitudinal slot of the body member. The first collet member end is formed of a predetermined number of sections segregated by a predetermined number of channels. And the second collet member end extends past the second body member end in longitudinal space relation. The locking nut engages the second collet member end and will be discussed in more detail infra.

While the present invention will be described in connection with presently preferred embodiments, it will be understood that it is not intended to limit the invention to those embodiments. On the contrary, it is intended to cover all alternatives, modifications, and equivalents included within the spirit of the invention and as defined in the appended claims.

DETAILED DESCRIPTION

The present apparatus and method for use will now be described more fully hereinafter with reference to the accompanying drawings, in which embodiments of the apparatus are shown. This apparatus may, however, be embodied in many different forms and should not be construed as limited to the embodiments set forth herein; rather, these embodiments are provided so that this disclosure will be thorough and complete and will fully convey the scope of the method to those skilled in the art. Like numbers refer to like elements throughout.

The term "collet" as used herein is defined as a member of predetermined cross-sectional design consisting of a tapered flange used for holding an item of predetermined cross-sectional design. Therefore, the use of the term "collet" in this application is more expansive than the common definition wherein a collet is commonly known in the art as a cone-shaped sleeve used for holding circular pieces in a lathe or machine. In this application, a collet is not limited to a circular cross-sectional design.

Figure 1:
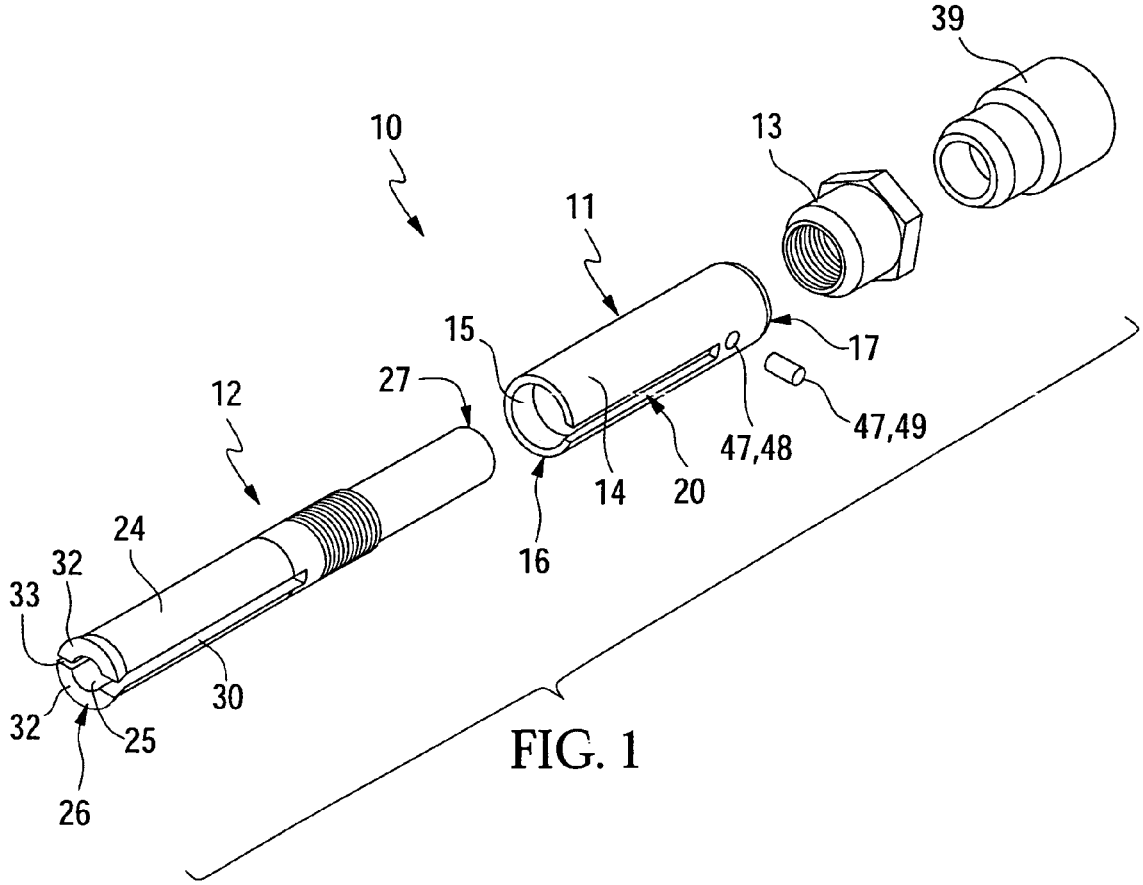
FIG. 1 is a perspective view of an embodiment of an adapter.
Figure 2:
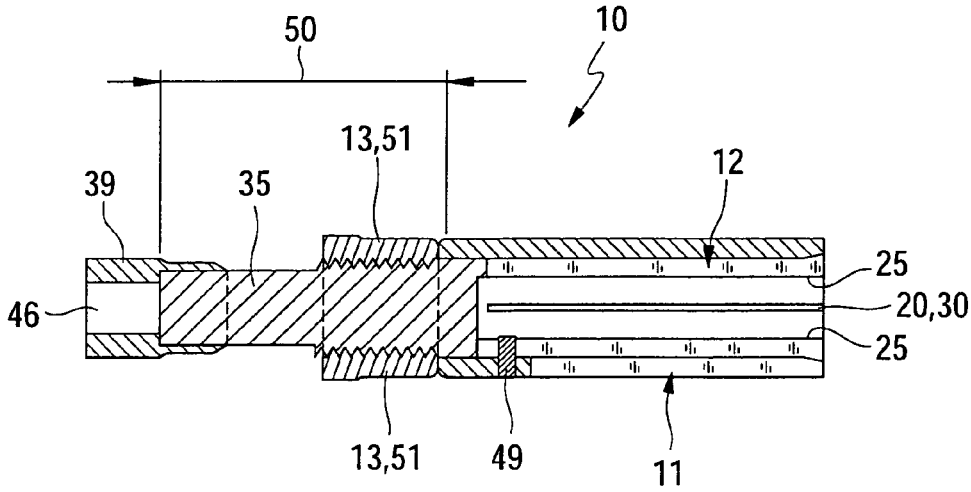
FIG. 2 is a side sectional view of an embodiment of an adapter.

Referring to the drawings, particularly FIGS. 1 and 2, there is shown an embodiment of an adapter 10 of suitable dimensions and of suitable material (such as, for example stainless steel, zinc, zinc plus yellow dischromate or hot dip galvanized or other suitable material) constructed in accordance with the elements described infra and supra. In an embodiment, the adapter 10 is comprised of a simple and elegant three-piece robust construction comprising a body member 11, a collet member 12, and a locking nut 13. All components described herein are scaleable based on predetermined requirements.

Body Member

Figure 4:
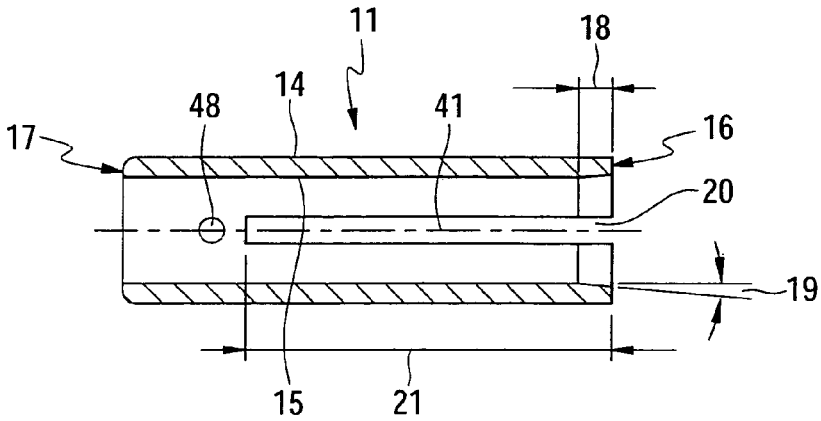
FIG. 4 illustrates an embodiment of a body member.
Figure 6:
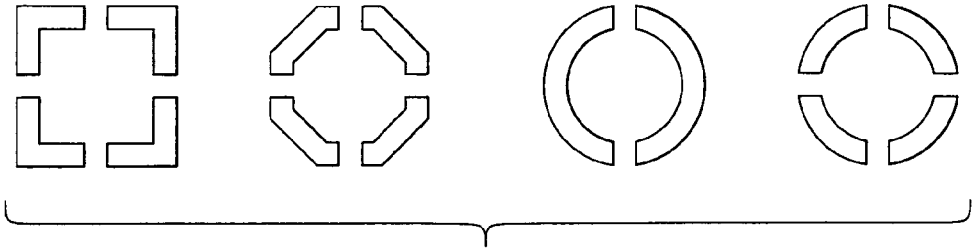
FIG. 6 illustrates examples of various cross-sectional designs and designs of channels and sections of a first collet member end.

With continued reference to FIGS. 1 and 2 as well as with reference to FIG. 4, in an embodiment, the body member 11 is elongated having a first longitudinal axis 41. Further, in an embodiment, the body member 11 is hollow with an outer body member surface 14 and an inner body member surface 15. The diameters of the outer and inner body member surfaces, in particular, as well as the dimensions for the entire body member 11 are scaleable based on predetermined requirements. The body member 11 has a first body member end 16 and a second body member end 17. In an embodiment, the inner body member surface 15 at the first body member end 16 is tapered for a predetermined first length 18 at a predetermined first taper angle 19. Various embodiments relative to the body member's cross-sectional design exist. For example, the outer body member surface and inner body member surface's cross-section may be substantially hexagonal, circular, square, or predetermined based on compatibility with a given collet design. FIG. 6 illustrates examples of varying cross-sectional designs for a first collet member end, however, FIG. 6 also provides the reader with examples of how varying cross-sectional designs may be implemented for a body member. The cross-sectional designs of the outer and inner body member surfaces can be equivalent or not equivalent. For example the outer body member cross-section may be circular wherein the inner body member cross-section may be hexagonal. It is stress throughout herein that multiple embodiments exist. The purpose of the taper of the inner body member surface 15 at the first body member end 16 is to provide an elegant means for applying a compressive load, which will be described in more detail infra. Further, a first longitudinal slot 20 extends from the first body member end 16 towards the second body member end 17 parallel to the first longitudinal axis 41 for a predetermined second length 21. This second length 21 is scaleable and is used, in part, to extend the cable 22 away from the adapter 10 such that the adapter 10 can firmly capture the connector 23. Thus, the width of the first longitudinal slot 20 is also scaleable based on a predetermined range of cable diameters. In an embodiment, the body member 11 comprises a means for limiting 47 the locking nut in longitudinal spaced relation wherein the body member 11 has a predetermined diameter such that the locking nut 13 eventually comes in contact with the body member 11. Further, in a second embodiment, the body member is comprised of varying diameters. It is again stress that multiple embodiments exist for a means for limiting a locking nut. With reference to FIG. 1, an indent 48 and a pin 49, which is inserted into the indent 48, is a means for limiting 47 the locking nut in longitudinal spaced relation by limiting the user from turning the locking nut 13 by limiting the compression of the body member 11 against the collet member 12, discussed in more detail infra. A molded pin is another means for limiting 47 the locking nut in longitudinal spaced relation.

Collet Member

Figure 5:
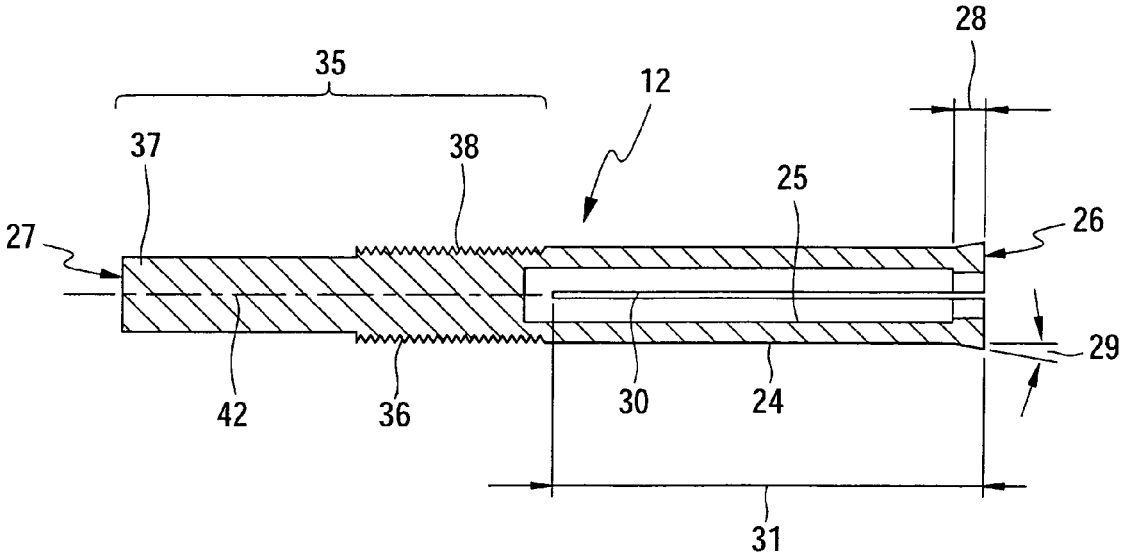
FIG. 5 illustrates an embodiment of a collet member.

With continued reference to FIGS. 1 and 2 as well as with reference to FIG. 5, in an embodiment, the collet member 12 is elongated having a second longitudinal axis 42. The collet member 12 is comprised of a first collet member end 26, a second collet member end 27, an outer collet member surface 24, and an inner collet member surface 25. Various embodiments relative to the collet member's cross-sectional design exist. For example, the cross-section may be substantially hexagonal, round, square, or predetermined based on compatibility with a given connector. FIG. 6 illustrates examples of varying cross-sectional designs. In general, the collet member's cross-sectional design should match the body member's cross-sectional design, however, this is not a requirement. In general, the inner body member surface's cross-sectional design matches the outer collet member surface's cross-sectional design, however, this is not a requirement. For example, in an embodiment, the outer body member surface's cross-sectional design is not equivalent to the outer collet member surface's cross-sectional design. In another embodiment, the inner body member surface's cross-sectional design is not equivalent to the inner collet member surface's cross-sectional design. Further, in an embodiment the collet member 12 is substantially hollow with an outer collet member surface 24 and an inner collet member surface 25. The diameters of the outer and inner collet member surfaces, in particular, as well as the dimensions for the entire collet member are scaleable based on predetermined requirements. As discussed supra, the collet member 12 has a first collet member end 26 and a second collet member end 27. In an embodiment, the first collet member end 26 is magnetized to aid in the securing of a connector 23 formed of a ferrous material. In an embodiment, the collet member 12 is hollow at the first collet member end 26, but not at the second collect member end 27. In another embodiment, the collet member is hollow throughout its entire longitudinal length. The collet member 12 is positioned inside the body member 11. Thus, the collet member's dimensions are predetermined based partly on the dimensions of the body member 11.

In an embodiment, the outer collet member surface 24 at the first collet member end 26 is tapered for a predetermined third length 28 at a predetermined second taper angle 29. As discussed supra, the inner body member surface 15 taper at the first body member end 16 is used to provide a compressive load. Specifically, in an embodiment, the predetermined first taper angle 19 of the inner body member surface 15 taper at the first body member end 16 is less than the second taper angle 29 of the outer collet member surface 24 at the first collet member end 26. If the collet member 12 is inserted into the body member 11 by inserting the second collect member end 27 through the first body member end 16, the point of stoppage will occur at some point when the outer collet member surface 24 near the first collet member end 26 engages the inner body member surface 15 near the first body member end 16. Thus, due to the differences in the first and second taper angles, a compressive force can be applied at the first collet member end 26 through a means for pulling 51 the first collet member end 26 towards the direction of the second body member end 17. The means for pulling 51 the first collet member end 26 towards the direction of the second body member end 17 will be discussed supra.

Further, a second longitudinal slot 30 extends from the first collet member end 26 towards the second collet member end 27 parallel to the second longitudinal axis 42 for a predetermined fourth length 31. This fourth length 31 is scaleable and is used, in part, to extend the cable 22 away from the adapter 10 such that the adapter 10 can firmly capture the connector 23. Thus, the width of the second longitudinal slot 30 is also scaleable based on a predetermined range of cable diameters. In general, both the width and length of the second longitudinal slot 30 should be substantially equal to the width and length of the first longitudinal slot 20. Further, upon insertion of the collet member 12 into the body member 11, the first and second longitudinal slots 20, 30 are aligned to form a single functional slot.

Figure 8:
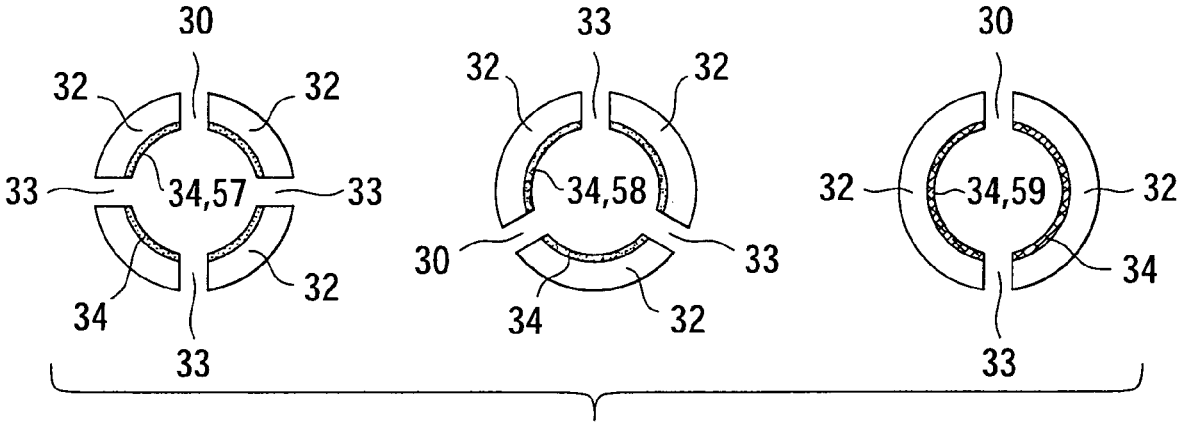
FIG. 8 illustrates examples of segregation of sections at a first collet member end.

Relative to the first collect member end 26, in an embodiment, the first collet member end 26 is used to engage and secure the connector 23. In an embodiment, the first collet member end 26 is formed of a predetermined number of sections 32 segregated by a predetermined number of channels 33. These sections provide flexibility at the first collet member end 26, which in turn, allows the first collet member end 26 to grip the connector 23 in a secure manner. In an embodiment, the first collet member end 26 is formed of four sections 32 with three channels 33. In this embodiment, the second longitudinal slot 30 serves to complete the segregation of sections. In another embodiment, the first collet member end is formed of two sections with one channel. In this particular embodiment, the second longitudinal slot serves to complete the segregation of sections. Thus, it is stressed that multiple embodiments exist relative to the number of sections and channels at the first collet member end. FIGS. 6 and 8 illustrates examples of multiple embodiments relative to the number of sections and channels. Additionally, in an embodiment, a variety of means for gripping 34 can be installed along the inner collet member surface 25 at the first collet member end 26. One means for gripping 34 is a silicon-based material 57 bonded to the inner collet member surface and the first collet member end. Another means for gripping 34 is a rubber-based material 58 bonded to the inner collet member surface at the first collet member end. Still another means for gripping 34 is an engraved pattern 59 of predetermined designed on the inner collet member surface at the first collet member end.

In an embodiment, the second collet member end 27 extends past the second body member end 17 for a predetermined fifth length 50 upon installation of the collet member 12 substantially in the body member 11. This extension portion 35 is comprised of a means for engaging 36 a locking nut, which will be discussed more supra, and a means for attaching 37 a second adapter 39 or tool, such as a torque driver.

Figure 7A:
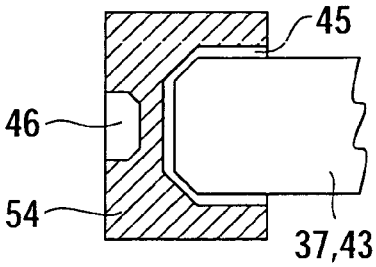
FIGS. 7A and 7B illustrate examples of various means for attaching.
Figure 7B:
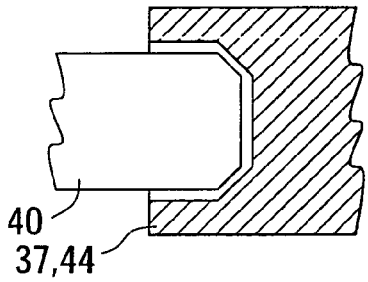

With reference to FIGS. 7A and 7B, multiple embodiments exist for a means for attaching 37 a second adapter or tool to the collet member. For example, the second collet member end can be formed of an extended nut of predetermined cross-section, which can be inserted into a socket wherein the socket is attached to a drill, torque wrench, torque driver, or the like (not otherwise shown). As another example, a third adapter 54 can be attached to an extended nut configuration 43 wherein the third adapter 54 is comprised of a first and second socket 45,46 on either end. The first socket 45 is used to engage the extended nut 43 at the second collet member end 27. The second socket 46 is used to engage an applicator tool. As still another example, the second collet member end can be formed of a second collet member end socket 44 wherein an "on-axis" applicator tool, such as a torque driver, can directly attach to the collet member 12. As still another example, the second collet member end 27 may comprise a means for attaching 37 wherein a second adapter 39 may be installed at the second collet member end 27.

Locking Nut

Figure 9:
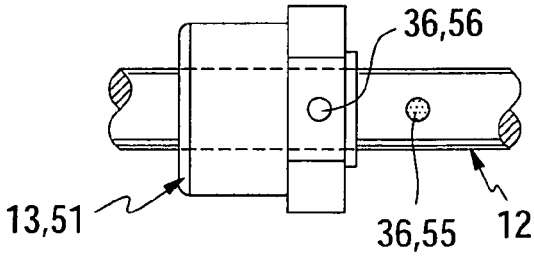
FIG. 9 illustrates an example of a means for engaging.

In an embodiment, the locking nut 13 engages the collet member 12 at the collet member extension portion 35. Multiple embodiments exist for a means for engaging 36 the locking nut to the collet member 12. With reference to FIG. 1, in an embodiment, a means for engaging 36 the locking nut 13 is coupled to the collet member via engraved threads 38 in a nut to bolt configuration. Thus, in this respect, as the locking nut 13 is screwed to the collet member 12, the locking nut 13 represents a means for pulling 51 the first collet member end 26 towards the direction of the second body member end 17. The locking nut 13 can be either hand tightened or tightened via the use of a tool. With reference to FIG. 9, in another embodiment for a means for engaging 36, the locking nut 13 is attached via a slideable means moved longitudinally along the collet member's length and locked into place by a second pin 55 and eyelet 56. Thus, the aforementioned configuration also embodies a means for pulling 51 the first collet member end 26 towards the direction of the second body member end 17. The purpose of the locking nut 13 is to simultaneously move the collet member 12 and the body member 11 in opposite longitudinal directions. As discussed supra, by moving the collet member 12 within the body member 11, a substantially uniform compressive load is produced at the first collet member end 26 due to the differences in the first and second taper angles. The combination of the locking nut 13, collet member 12, and body member 11 design produces a simple, yet elegant means for securing a connector within the present adapter.

Method for Use

Figure 3A:
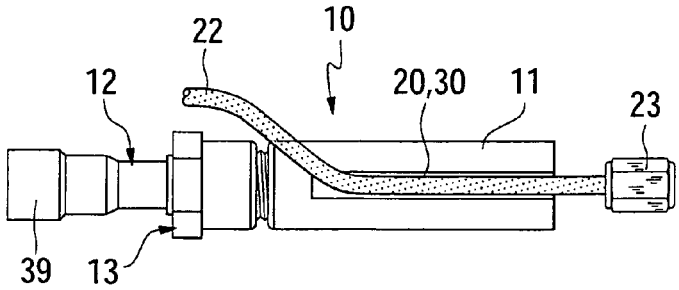
FIG. 3A illustrates an embodiment of an adapter in space relation to a cable connector.
Figure 3B:
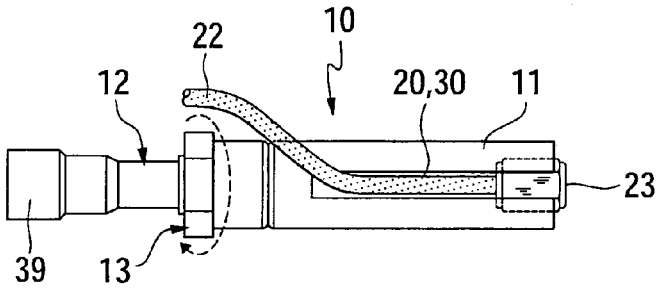
FIG. 3B illustrates an embodiment of an adapter with a cable connector captured by the adapter.
Figure 3C:
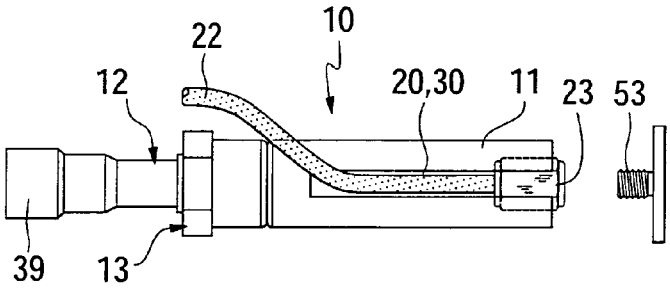
FIG. 3C illustrates an embodiment of an adapter with a cable connector captured by the adapter in space relation with a terminal post.
Figure 3D:
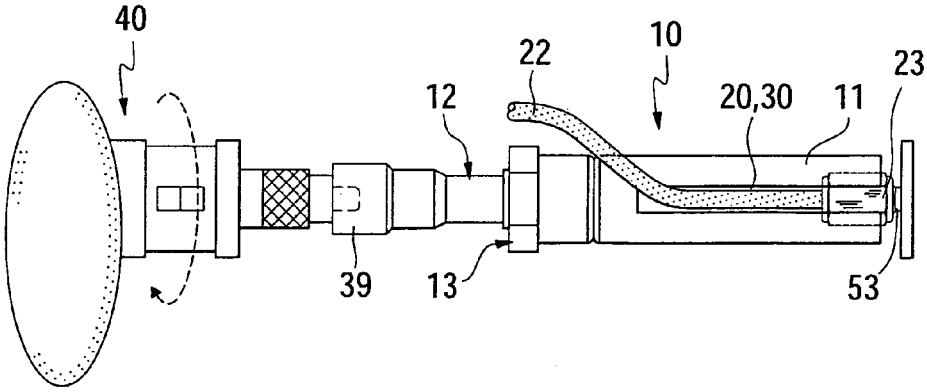
FIG. 3D illustrates an embodiment of an adapter in combination with a torque driver wherein the torque driver is being used to attach the cable connector to a terminal post.
Figure 3E:
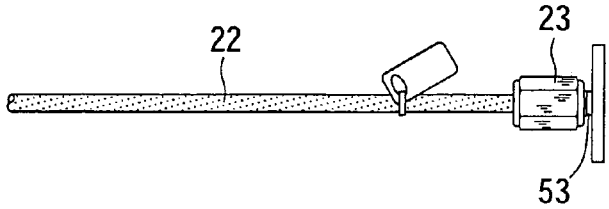
FIG. 3E illustrates a cable connection after installation on a terminal post.

Multiple methods exist for the various embodiment described supra. For example, with reference to FIGS. 3A-3E, prior to installation, cable 22 is placed through the first and second longitudinal slots 20, 30. After the cable 22 is placed through the first and second longitudinal slots 20, 30, the connector 23 is positioned in parallel spaced relation with the adapter 10. The connector 23 is then positioned in the first collet member end 26 such that the first collet member end 26 substantially engages the connector 23. The connector 23 can be positioned either by moving the connector 23 itself or pulling the cable 22 simultaneously with aligning the connector 23 along the longitudinal axis of the adapter. As illustrated in FIG. 3B, once the connector 23 is firmly engaged in the first collet member end 26, the locking nut 13 is activated such that the collet member 12 and body member 11 are simultaneously moved in opposite longitudinal directions. As discussed supra, due to the difference in the first and second taper angles 19, 29, a compressive load is applied at the first collet member end 26. The locking nut 13 is tightened until a desired compressive load limit is reached such that the connector 23 is securely engaged in the first collet member end 26 and such that the adapter 10 will maintain its full capture to the connector 23 as the connector 23 is being installed. The locking nut 13 may be tightened by hand or by an external tool, such as a wrench (not otherwise shown). This step may also be referred to as "activating the locking nut." Next, the adapter 10 with the connector 23 firmly attached thereto, is positioned for installing the connector 23. As an example and as illustrated in FIG. 3C, the adapter 10 with the connector firmly attached thereto, is positioned for installation to a terminal post 53. Subsequently, the adapter 10 is secured to an appropriate attachment tool and the connector 23 is properly installed per predetermined requirements. In a method for use, as an example and as illustrated in FIG. 3D, a torque driver 40 is used to install the connector 23 with a predetermined torque requirement to a terminal post 53. The locking nut 13 is loosened to reduce the compressive force at the first collet member end 26. This step may also be referred to as "de-activating the locking nut." The adapter 10 is removed from the connector 23 and the cable 22 is "threaded" out of the first and second longitudinal slots 20, 30. As an example and as illustrated in FIG. 3E, the connector 23 is now properly installed on a terminal post 53.

Having described the invention above, various modifications of the techniques, procedures, materials, and equipment will be apparent to those skilled in the art. It is intended that all such variations within the scope and spirit of the invention be included within the scope of the appended claims.

What is claimed is:

1. A method for installing a connector at the end of a cable on a terminal post comprising the steps of:

providing an adapter comprised of:

an elongated body member having a first longitudinal axis comprised of:

a first body member end, a second body member end, an outer body member surface, and an inner body member surface, wherein the inner body member surface at the first body member end is tapered for a predetermined first length at a predetermined first taper angle, and wherein a first longitudinal slot extends along the first longitudinal axis initiating at the first body member end for a predetermined second length, an elongated collet member coupled to the body member wherein the collet member has a second longitudinal axis comprised of:

a first collet member end, a second collet member end, an outer collet member surface, and an inner collet member surface, wherein the outer collet member surface is positioned inside the inner body member surface in longitudinal spaced relation, wherein the inner collet member surface at the first collet member end is used to engage the connector, wherein the outer collet member surface at the first collet member end is tapered for a predetermined third length at a predetermined second taper angle, wherein a second longitudinal slot extends along the second longitudinal axis initiating at the first collet member end for a predetermined fourth length, wherein the second longitudinal slot is substantially aligned with the first longitudinal slot, wherein the first collet member end is formed of a predetermined number of sections segregated by a predetermined number of channels and the second longitudinal slot, and wherein the second collet member end extends past the second body member end in longitudinal space relation for a predetermined fifth length, and a locking nut coupled to the collet member;

threading in the cable through the first and second longitudinal slots of the adapter;

positioning the connector in the first collet member end such that the first collet member end substantially engages the connector;

activating the locking nut such that the collet member and body member are simultaneously moved in opposite longitudinal directions and such that a desired compressive load is applied to the connector to secure the connector to the collet member at the first collet member end;

installing the connector on the terminal post;

de-activating the locking nut to release the compressive load on the connector;

disengaging the connector from the collet member at the first collet member end; and threading out the cable from the first and second longitudinal slots.

2. The method as in claim 1, wherein the step of installing the connector is comprised of the following substeps:

positioning the connector in close proximity to the terminal post in longitudinal spaced relation;

first tightening the connector to the terminal post using the adapter until resistance from the terminal post is sensed;

attaching a torque driver to the adapter at the second collet member end wherein the second collet member end is formed of a means for engaging a tool; and second tightening the connector to the terminal post using the torque driver attached to the adapter to a predetermined torque limit.

3. The method as in claim 1, wherein, in the step of providing an adapter, the body member's outer body member surface and collet member's outer collet member surface are substantially cylindrical in shape.

4. The method as in claim 1, wherein, in the step of providing an adapter, the second taper angle is greater than the first taper angle.

5. The method as in claim 1, wherein, in the step of providing an adapter, the second collet member end is formed of a means for attaching a second adapter or tool.

6. The method as in claim 5, wherein the step of installing the connector is comprised of the following substeps:

positioning the connector in close proximity to the terminal post in longitudinal spaced relation;

providing a tool comprised of a wrench;

attaching the wrench to the adapter at the second collet member end; and tightening the connector to the terminal post using the wrench attached to the adapter until a desired resistance is sensed.

7. The method as in claim 1, wherein, in the step of providing an adapter, the adapter is further comprised of a means for gripping installed along the inner collet member surface at the first collet member end.

8. The method as in claim 1, wherein, in the step of providing an adapter, the adapter is further comprised of a means for limiting the locking nut in longitudinal spaced relation.

* * * * *